US009557689B2

(12) United States Patent
Uemura

(10) Patent No.: US 9,557,689 B2
(45) Date of Patent: Jan. 31, 2017

(54) IMAGE FORMING APPARATUS HAVING A DRIVING MECHANISM THAT DISPLACES TRANSFER ROLLERS

(71) Applicant: KYOCERA Document Solutions Inc., Osaka-shi, Osaka (JP)

(72) Inventor: Satoshi Uemura, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 15/002,301

(22) Filed: Jan. 20, 2016

(65) Prior Publication Data

US 2016/0209784 A1 Jul. 21, 2016

(30) Foreign Application Priority Data

Jan. 21, 2015 (JP) ..... 2015-009726

(51) Int. Cl.
*G03G 15/01* (2006.01)
*G03G 15/16* (2006.01)

(52) U.S. Cl.
CPC .. *G03G 15/1615* (2013.01); *G03G 2215/0132* (2013.01); *G03G 2215/0193* (2013.01)

(58) Field of Classification Search
CPC ..... G03G 15/0189; G03G 15/1615
USPC ..... 399/101, 298, 299, 302
See application file for complete search history.

(56) References Cited

U.S. PATENT DOCUMENTS 8,213,846 B2 * 7/2012 Saito ..... G03G 15/1615 399/302
8,346,138 B2 * 1/2013 Sugitani et al. ... G03G 15/1615 399/299
8,897,672 B2 * 11/2014 Takagi ..... G03G 15/0189 399/302
8,977,171 B2 * 3/2015 Yokoyama et al. ..... G03G 15/1615 399/298

FOREIGN PATENT DOCUMENTS

JP 2005003983 A 1/2005
JP 2007093780 A 4/2007
JP 2007178864 A 7/2007

* cited by examiner

*Primary Examiner* — William J Royer
(74) *Attorney, Agent, or Firm* — Alleman Hall McCoy Russell & Tuttle LLP

(57) ABSTRACT

An image forming apparatus includes an intermediate transfer belt, a plurality of belt rollers, a plurality of transfer rollers, a cleaning member, a first driving portion, a second driving portion, and a running control portion. The first driving portion is capable of causing the respective transfer rollers to come into contact with or separate from the intermediate transfer belt. The second driving portion is capable of changing orientation of predetermined one or a plurality of movable rollers among the plurality of belt rollers. The running control portion executes a running process including: causing the first driving portion to separate the respective transfer rollers from the intermediate transfer belt; causing the second driving portion to change the orientation of the movable roller to orientation different from that during execution of an image forming process; and causing the intermediate transfer belt to run.

8 Claims, 10 Drawing Sheets

450
401
490
407
408
409
419
420
453
454
421
422
404
423
424
455
425
456
428
410
452
76
761
41
490
406
45BK
71
45C
45M
45Y
75
751

450
402
490
413
414
415
427
428
453
429
451
430
406
454
45C
431
432
455
433
434
456
416
417
452
761
76
41
490
406
45BK
71
451
45M
45Y
75
751

IMAGE FORMING APPARATUS HAVING A DRIVING MECHANISM THAT DISPLACES TRANSFER ROLLERS

INCORPORATION BY REFERENCE

This application is based upon and claims the benefit of priority from the corresponding Japanese Patent Application No. 2015-009726 filed on Jan. 21, 2015, the entire contents of which are incorporated herein by reference.

BACKGROUND

The present disclosure relates to an image forming apparatus including a transfer device for transferring a toner image onto a sheet member.

An image forming apparatus has been known in which an intermediate transfer belt extended on and between a plurality of belt rollers is held between a transfer roller and an image carrier, a toner image formed on the surface of the image carrier is transferred onto the intermediate transfer belt, and the toner image is transferred onto a sheet member. This type of image forming apparatus may be provided with a cleaning blade for removing residual toner from the surface of the intermediate transfer belt after the toner image has been transferred onto the sheet member. The cleaning blade is disposed in contact with the intermediate transfer belt, and removes the residual toner from the surface of the running intermediate transfer belt.

By the way, there are cases where foreign matters, such as paper dust attached to the surface of the intermediate transfer belt or aggregates of an external additive, may enter a gap between a tip of the cleaning blade and the surface of the intermediate transfer belt. If the cleaning blade is slid on the intermediate transfer belt with the foreign matters remaining in the gap, the surface of the intermediate transfer belt or the tip of the cleaning blade may be damaged.

Meanwhile, a structure has been known in which an intermediate transfer belt is moved in a direction of the width of belt rollers by moving one ends of the belt rollers upward or downward.

SUMMARY

An image forming apparatus according to an aspect of the present disclosure includes an intermediate transfer belt, a plurality of belt rollers, a plurality of transfer rollers, a cleaning member, a first driving portion, a second driving portion, and a running control portion. Onto the intermediate transfer belt, toner images formed on a plurality of image carriers are transferred. The plurality of belt rollers include a driving roller that causes the intermediate transfer belt to run, and extending rollers on and between which the intermediate transfer belt is extended. The plurality of transfer rollers hold the intermediate transfer belt between the transfer rollers and the respective image carriers. The cleaning member is disposed in contact with a surface of the intermediate transfer belt. The first driving portion is capable of causing the respective transfer rollers to come into contact with or separate from the intermediate transfer belt. The second driving portion is capable of changing orientation of predetermined one or a plurality of movable rollers among the plurality of belt rollers. The running control portion executes a running process including: causing the first driving portion to separate the respective transfer rollers from the intermediate transfer belt; causing the second driving portion to change the orientation of the movable roller to orientation different from that during execution of an image forming process; and causing the intermediate transfer belt to run.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, embodiments of the present disclosure will be described with reference to the accompanying drawings. It should be noted that the following embodiments are examples embodying the present disclosure, and, by nature, do not limit the technical scope of the present disclosure. In the following description, an up-down direction 801, a left-right direction 802, and a front-rear direction 803 which are defined in FIG. 1 may be used.

Figure 1:
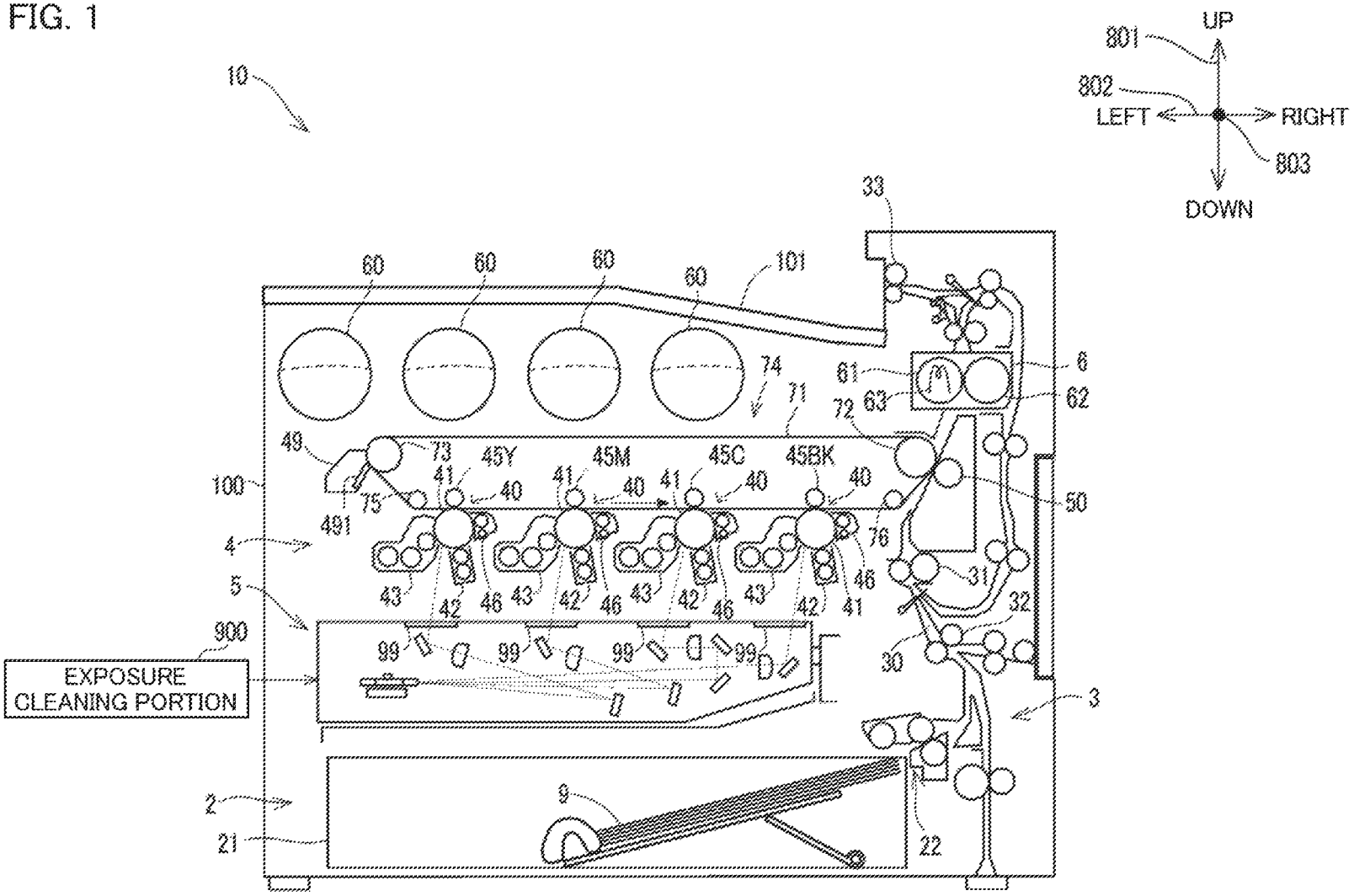
FIG. 1 is a schematic diagram showing the configuration of an image forming apparatus according to a first embodiment of the present disclosure.

The configuration of an image forming apparatus 10 according to a first embodiment of the present disclosure will be described with reference to FIG. 1 and FIG. 2. The image forming apparatus 10 is an electrophotographic type image forming apparatus. As shown in FIG. 1, the image forming apparatus 10 includes, in a housing 100, a sheet supply portion 2, a sheet conveying portion 3, a toner supply portion 60, an image forming portion 4, a laser scanning portion 5, a fixing portion 6, and the like.

The sheet supply portion 2 includes a sheet storage portion 21, and a sheet feed portion 22. In the sheet storage portion 21, a plurality of sheet members 9 can be stacked and placed. Each sheet member 9 is a sheet-like medium on which image formation is performed, such as paper, coated paper, a postcard, an envelope, or an OHP sheet. The sheet feed portion 22 is rotated in contact with the sheet member 9 to feed the sheet member 9 from the sheet storage portion 21 toward a conveyance path 30.

The sheet conveying portion 3 includes a registration roller 31, a conveyance roller 32, a discharge roller 33, and the like. The registration roller 31 and the conveyance roller 32 convey the sheet member 9 fed from the sheet supply portion 2 toward a secondary transfer roller 50 in the image forming portion 4. Further, the discharge roller 33 discharges the sheet member 9 on which an image has been formed, from a discharge port of the conveyance path 30 onto a discharge tray 101.

The image forming apparatus 10 shown in FIG. 1 is a tandem type image forming apparatus, and is able to form a color image and a monochrome image. Therefore, the image forming portion 4 further includes an intermediate transfer belt 71, a secondary cleaning device 49, and the secondary transfer roller 50. The image forming apparatus 10 is, for example, a printer, a copying machine, a facsimile machine, a multifunction peripheral, or the like. The multifunction peripheral has functions of the printer, the copying machine, and the like.

The image forming portion 4 includes a plurality of monochrome image forming portions 40 corresponding to colors of yellow, magenta, cyan, and black, respectively. Further, the image forming apparatus 10 includes a plurality of toner supply portions 60 for supplying toners of the respective colors of cyan, magenta, yellow, and black to later-described developing devices 43. The toner supply portions 60 are detachable from the housing 100. In the present embodiment, the toner supply portions 60 are mounted to a position above the image forming portion 4.

The intermediate transfer belt 71 is an endless belt-like member formed in an annular shape. The intermediate transfer belt 71 is extended on and between a driving roller 72, a follower roller 73, and backup rollers 75, 76. The driving roller 72 is driven by a driving motor (not shown) to be rotated. The intermediate transfer belt 71 is caused to run by the driving roller 72 being driven by the driving motor. The follower roller 73 and the backup rollers 75, 76 are examples of extending rollers that stretch and support the intermediate transfer belt 71. The driving roller 72, the follower roller 73, and the backup rollers 75, 76 are examples of belt rollers of the present disclosure.

Toner images formed on later-described photosensitive drums 41 in the respective monochrome image forming portions 40 are transferred onto the intermediate transfer belt 71 so as to be superimposed on each other. Thereby, a color image in which the images of the respective colors are superimposed is formed on the intermediate transfer belt 71. When the toner images formed on the photosensitive drums 41 are transferred onto the intermediate transfer belt 71, the intermediate transfer belt 71 is held between primary transfer rollers 45Y, 45M, 45C, and 45BK and the photosensitive drums 41. The primary transfer rollers 45 are examples of transfer rollers of the present disclosure.

The backup roller 75 is provided in the vicinity of the follower roller 73. The backup roller 76 is provided in the vicinity of the driving roller 72. The specific positions of the backup rollers 75, 76 will be described later.

The intermediate transfer belt 71, the driving roller 72, and the follower roller 73 are formed into a unit. This unit is referred to as a transfer belt unit 74. The transfer belt unit 74 is detachable from the housing 100.

Each of the monochrome image forming portions 40 includes a photosensitive drum 41, a charging device 42, a developing device 43, a primary transfer roller 45, a primary cleaning device 46, and the like. The photosensitive drum 41 is an example of an image carrier of the present disclosure.

Each of the photosensitive drums 41 is rotated at a circumferential speed in accordance with a circumferential speed (movement speed) of the intermediate transfer belt 71. For example, it is conceivable that the photosensitive drum 41 is an organic photosensitive body. It is also conceivable that the photosensitive drum 41 is an amorphous silicon photosensitive body. The photosensitive drum 41 is an example of a photosensitive body that carries a toner image while rotating.

The charging device 42 includes a charging roller (not shown) that charges a portion of the photosensitive drum 41, on which an electrostatic latent image has not yet been formed.

The laser scanning portion 5 applies laser light based on image data to each of the photosensitive drums 41 through each of light-transmitting emission windows 99 provided on the outer surface of a housing, thereby forming an electrostatic latent image on each photosensitive drum 41. The laser scanning portion 5 is provided with an exposure cleaning portion 900 that cleans each of the emission windows 99. Although details are not described, the exposure cleaning portion 900 has a blade (not shown) formed of an elastic member such as silicon resin, and cleans each emission window 99 by causing the blade to move in contact with the emission window 99 and slide on the emission window 99. The laser scanning portion 5 is an example of an exposure portion of the present disclosure.

In each monochrome image forming portion 40, the photosensitive drum 41 is rotated, and the charging device 42 uniformly charges the surface of the photosensitive drum 41. Further, the laser scanning portion 5 scans the surface of the charged photosensitive drum 41 with the laser light to write the electrostatic latent image on the surface of the photosensitive drum 41.

The developing device 43 supplies toner to the photosensitive drum 41 to develop the electrostatic latent image. The developing device 43 according to the present embodiment charges the toner by agitating a developer including the toner, and supplies the charged toner to the photosensitive drum 41.

As shown in FIG. 1, each primary transfer roller 45 is provided on the opposite side from the photosensitive drum 41 with respect to the intermediate transfer belt 71. The primary transfer roller 45 is supported by the housing 100 so as to be movable in the up-down direction 801. The primary transfer roller 45 is moved between a transfer position and a separation position by a later-described driving mechanism 400. The transfer position is a position where the primary transfer roller 45 is in contact with the surface of the intermediate transfer belt 71, and holds the intermediate transfer belt 71 between itself and the photosensitive drum 41. The separation position is a position where the primary transfer roller 45 is spaced apart from the intermediate transfer belt 71.

When a transfer voltage is applied to the primary transfer roller 45 in the state where the primary transfer roller 45 is located at the transfer position, the toner image formed on the surface of the photosensitive drum 41 is transferred onto the intermediate transfer belt 71 due to an electrostatic force caused by the transfer voltage. In the following description, reference characters "Y", "M", "C", and "BK" may be appended to the reference numeral "45" indicating the primary transfer rollers to identify the respective primary transfer rollers 45 for the corresponding colors.

The backup rollers 75, 76 are also supported by the housing 100 so as to be movable in the up-down direction 801, like the primary transfer roller 45. The backup rollers 75, 76 are movable between a contact position and a non-contact position by the driving mechanism 400 (refer to FIG. 2). The contact position is a position where the backup roller 75, 76 is in contact with the surface of the intermediate transfer belt 71. The non-contact position is a position where the backup roller 75, 76 is not in contact with the intermediate transfer belt 71.

The backup roller 75 is disposed near the upstream side of the primary transfer roller 45Y corresponding to yellow which is disposed on the most upstream side among the plurality of primary transfer rollers 45 corresponding to the respective colors. When a color image is formed, the backup roller 75 sets an angle at which the intermediate transfer belt 71 enters a portion held between the primary transfer roller 45Y corresponding to yellow and the photosensitive drum 41, to a predetermined angle, thereby preventing the intermediate transfer belt 71 from applying an excessive force to the primary transfer roller 45Y.

The backup roller 76 is disposed near the downstream side of the primary transfer roller 45BK corresponding to black which is disposed on the most downstream side among the plurality of primary transfer rollers 45 corresponding to the respective colors. The backup roller 76 sets an angle at which the intermediate transfer belt 71 exits a portion held between the primary transfer roller 45BK and the photosensitive drum 41, to a predetermined angle, thereby preventing the intermediate transfer belt 71 from applying an excessive force to the primary transfer roller 45BK.

The secondary transfer roller 50 transfers the color toner image formed on the intermediate transfer belt 71 onto the sheet member 9. The secondary cleaning device 49 has a cleaning blade 491. The cleaning blade 491 is in contact with the surface of the running intermediate transfer belt 71, and removes the residual toner on the intermediate transfer belt 71 that has passed through the secondary transfer roller 50. The cleaning blade 491 is an example of a cleaning member of the present disclosure.

The fixing portion 6 includes a fixing roller 61 and a pressure roller 62 which nip the sheet member 9 between them and heat the sheet member 9, thereby fixing the toner image formed on the sheet member 9 onto the sheet member 9. In the fixing roller 61, a heater 63 is fixed as a heat source that generates heat when current is applied thereto. The heater 63 is composed of, for example, a halogen heater or a ceramic heater, and radiates heat when current is applied thereto. Thus, the entire circumferential surface of the fixing roller 61 is heated from the inside. The heater 63 is an example of a heating portion of the present disclosure.

The image forming apparatus 10 includes the driving mechanism 400. The driving mechanism 400, as described below, displaces each of the primary transfer rollers 45 between the transfer position and the separation position, and changes the tilting states of the backup rollers 75, 76 within a plane orthogonal to the left-right direction 802. Hereinafter, the tilting states of the backup rollers 75, 76 are referred to as orientations of the backup rollers 75, 76.

Figure 2:
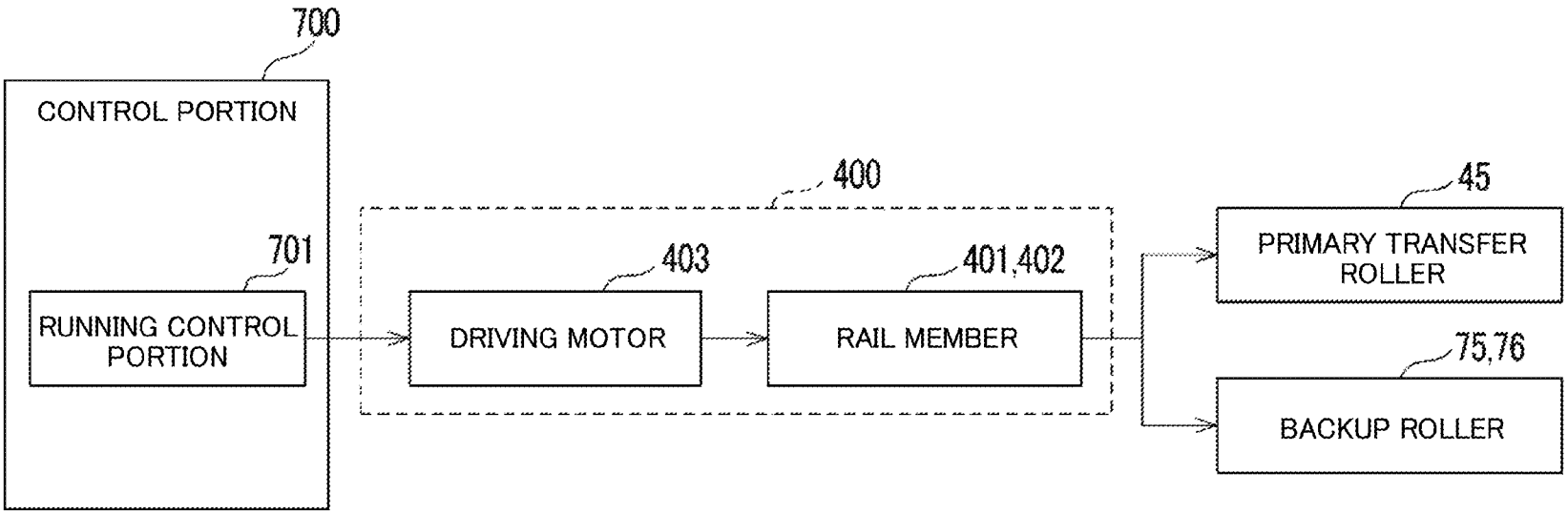
FIG. 2 is a block diagram of the image forming apparatus according to the first embodiment of the present disclosure.

As shown in FIG. 2, the driving mechanism 400 includes rail members 401, 402, and a driving motor 403. The driving motor 403 is an example of a rail driving portion of the present disclosure.

Figure 3A:
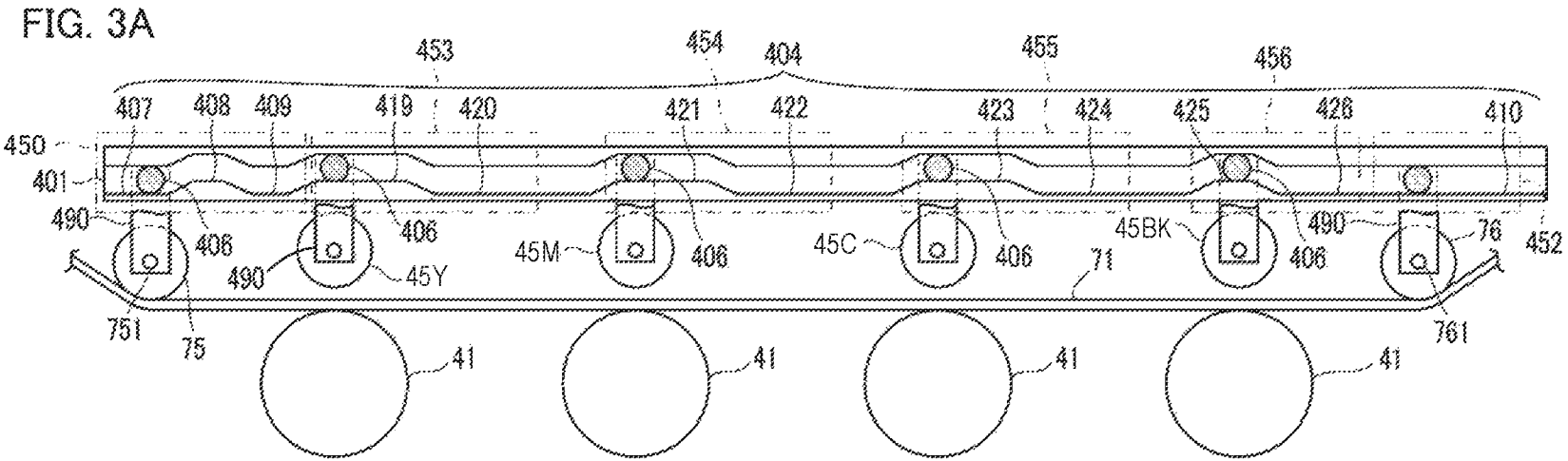
FIG. 3A and FIG. 3B are diagrams showing the configuration of a pair of rail members.
Figure 3B:
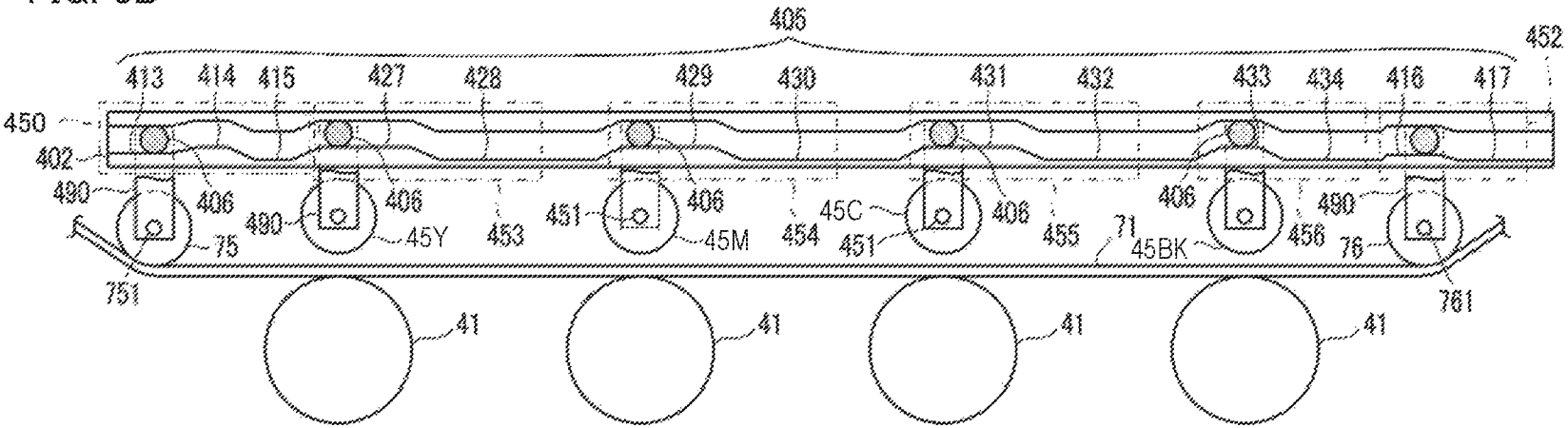

As shown in FIG. 3A, the rail member 401 extends from the backup roller 75 to the backup roller 76 in the left-right direction 802, at a position on the front side in the front-rear direction 803 of the image forming apparatus 10. As shown in FIG. 3B, the rail member 402 extends over the primary transfer rollers 45 of the respective monochrome image forming portions 40 from the backup roller 75 to the backup roller 76 in the left-right direction 802, at a position on the rear side in the front-rear direction 803 of the image forming apparatus 10. The rail member 401 and the rail member 402 are provided at the same height position.

Figure 5:
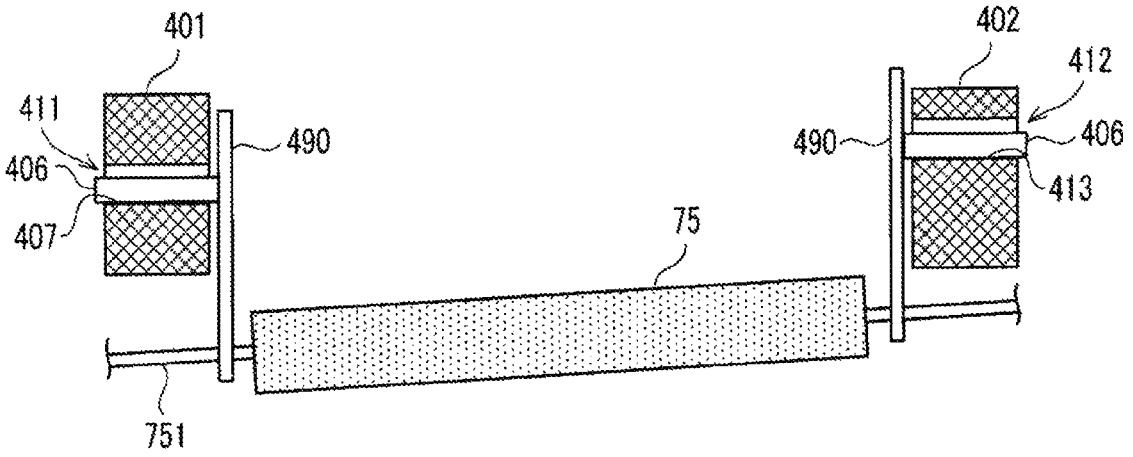
FIG. 5 is a diagram showing a state where the backup roller is tilted.

The rail members 401, 402 have guide grooves 411, 412 (refer to FIG. 5) formed extending in the longitudinal direction of the rail members 401, 402, respectively. Due to the guide grooves 411, 412, the rail member 401 has a slide surface 404, and the rail member 402 has a slide surface 405. Sliders 406 (refer to FIG. 3A and FIG. 3B) are attached to the backup rollers 75, 76 and the primary transfer rollers 45 via support plates 490. Specifically, a rotation shaft 751, 761 (refer to FIGS. 5, 6A, 6B) of the backup roller 75, 76 is fitted to a lower end portion of the support plate 490 and the slider 406 is provided at an upper end portion of the support plate 490. A rotation shaft 451 of each primary transfer roller 45 is fitted to a lower end portion of the support plate 490, and the slider 406 is provided at an upper end portion of the support plate 490. The slider 406 projects from the support plate 490 to the rail member 401, 402. The slide surface 404, 405 slidably supports the slider 406 attached to the backup roller 75, 76 and the slider 406 attached to each primary transfer roller 45.

As described later, the rail members 401, 402 are configured to be movable in the left-right direction 802 by the driving motor 403. The movements of the rail members 401, 402 in the left-right direction 802 cause the sliders 406 provided at the backup rollers 75, 76 and the primary transfer rollers 45 to slide relative to the slide surfaces 404, 405.

As shown in FIG. 3A and FIG. 3B, the slide surface 404 of the rail member 401 has first to fourth support surfaces 407 to 410 and tenth to seventeenth support surfaces 419 to 426, and the slide surface 405 of the rail member 402 has fifth to ninth support surfaces 413 to 417 and eighteenth to twenty-fifth support surfaces 427 to 434.

The first to third support surfaces 407 to 409 and the fifth to seventh support surfaces 413 to 415 configure a first guide portion 450 that slidably supports one end portion and the other end portion of the backup roller 75. The fourth support surface 410, the eighth support surface 416, and the ninth support surface 417 configure a second guide portion 452 that slidably supports one end portion and the other end portion of the backup roller 76.

The tenth and eleventh support surfaces 419, 420 and the eighteenth and nineteenth support surfaces 427, 428 configure a third guide portion 453 that slidably supports one end portion and the other end portion of the primary transfer roller 45Y corresponding to yellow. The twelfth and thirteenth support surfaces 421, 422 and the twentieth and twenty-first support surfaces 429, 430 configure a fourth guide portion 454 that slidably supports one end portion and the other end portion of the primary transfer roller 45M corresponding to magenta. The fourteenth and fifteenth support surfaces 423, 424 and the twenty-second and twenty-third support surfaces 431, 432 configure a fifth guide portion 455 that slidably supports one end portion and the other end portion of the primary transfer roller 45C corresponding to cyan. The sixteenth and seventeenth support surfaces 425, 426 and the twenty-fourth and twenty-fifth support surfaces 433, 434 configure a sixth guide portion 456 that slidably supports one end portion and the other end portion of the primary transfer roller 45BK corresponding to black.

The first support surface 407 and the fifth support surface 413 are located at the same position in the longitudinal direction of the rail members 401, 402. The second support surface 408 and the sixth support surface 414 are located at the same position in the longitudinal direction. The third support surface 409 and the seventh support surface 415 are located at the same position in the longitudinal direction. The fourth support surface 410, the eighth support surface 416, and the ninth support surface 417 are located at the same position in the longitudinal direction.

Therefore, in accordance with the movements of the rail members 401, 402, the backup roller 75 is allowed to take: a state of being supported by the first support surface 407 and the fifth support surface 413; a state of being supported by the second support surface 408 and the sixth support surface 414; and a state of being supported by the third support surface 409 and the seventh support surface 415.

Further, in accordance with the movements of the rail members 401, 402, the backup roller 76 is allowed to take: a state of being supported by the fourth support surface 410 and the eighth support surface 416; and a state of being supported by the fourth support surface 410 and the ninth support surface 417.

In the third guide portion 453 that slidably supports the primary transfer roller 45Y corresponding to yellow, the tenth support surface 419 and the eighteenth support surface 427 are located at the same position in the longitudinal direction and at the same height position. The eleventh support surface 420 and the nineteenth support surface 428 are located at the same position in the longitudinal direction and at the same height position. Therefore, the slider 406 provided at the primary transfer roller 45Y is allowed to take: a state of being supported by the tenth support surface 419 and the eighteenth support surface 427; and a state of being supported by the eleventh support surface 420 and the nineteenth support surface 428, in accordance with the movements of the rail members 401, 402.

The tenth support surface 419 and the eighteenth support surface 427 are located at positions higher than the eleventh support surface 420 and the nineteenth support surface 428. Therefore, the primary transfer roller 45Y is located at the higher position when the primary transfer roller 45Y is supported by the tenth support surface 419 and the eighteenth support surface 427 than when it is supported by the eleventh support surface 420 and the nineteenth support surface 428.

When the primary transfer roller 45Y is supported by the tenth support surface 419 and the eighteenth support surface 427, the primary transfer roller 45Y is spaced apart from the intermediate transfer belt 71. This position is the above-mentioned separation position. When the primary transfer roller 45Y is supported by the tenth support surface 419 and the eighteenth support surface 427, the primary transfer roller 45Y is in contact with the intermediate transfer belt 71. This position is the above-mentioned transfer position.

In the fourth guide portion 454 that slidably supports the primary transfer roller 45M corresponding to magenta, the twelfth support surface 421 and the twentieth support surface 429 are located at the same position in the longitudinal direction, and at the same height position. The thirteenth support surface 422 and the twenty-first support surface 430 are located at the same position in the longitudinal direction, and at the same height position. Therefore, in accordance with the movements of the rail members 401, 402, the slider 406 provided at the primary transfer roller 45M is allowed to take: a state of being supported by the twelfth support surface 421 and the twentieth support surface 429; and a state of being supported by the thirteenth support surface 422 and the twenty-first support surface 430.

The twelfth support surface 421 and the twentieth support surface 429 are located at positions higher than the thirteenth support surface 422 and the twenty-first support surface 430. Therefore, the primary transfer roller 45M is located at the higher position when the primary transfer roller 45M is supported by the twelfth support surface 421 and the twentieth support surface 429 than when it is supported by the thirteenth support surface 422 and the twenty-first support surface 430.

When the primary transfer roller 45M is supported by the twelfth support surface 421 and the twentieth support surface 429, the primary transfer roller 45M is spaced apart from the intermediate transfer belt 71. This position is the above-mentioned separation position. When the primary transfer roller 45M is supported by the thirteenth support surface 422 and the twenty-first support surface 430, the primary transfer roller 45M is in contact with the intermediate transfer belt 71. This position is the above-mentioned transfer position.

In the fifth guide portion 455 that slidably supports the primary transfer roller 45C corresponding to cyan, the fourteenth support surface 423 and the twenty-second support surface 431 are located at the same position in the longitudinal direction and at the same height position. The fifteenth support surface 424 and the twenty-third support surface 432 are located at the same position in the longitudinal direction and at the same height position. Therefore, in accordance with the movements of the rail members 401, 402, the slider 406 provided at the primary transfer roller 45C is allowed to take: a state of being supported by the fourteenth support surface 423 and the twenty-second support surface 431; and a state of being supported by the fifteenth support surface 424 and the twenty-third support surface 432.

The fourteenth support surface 423 and the twenty-second support surface 431 are located at positions higher than the fifteenth support surface 424 and the twenty-third support surface 432. Therefore, the primary transfer roller 45C is located at the higher position when the primary transfer roller 45C is supported by the fourteenth support surface 423 and the twenty-second support surface 431 than when it is supported by the fifteenth support surface 424 and the twenty-third support surface 432.

When the primary transfer roller 45C is supported by the fourteenth support surface 423 and the twenty-second support surface 431, the primary transfer roller 45C is spaced apart from the intermediate transfer belt 71. This position is the above-mentioned separation position. When the primary transfer roller 45C is supported by the fifteenth support surface 424 and the twenty-third support surface 432, the primary transfer roller 45C is in contact with the intermediate transfer belt 71. This position is the above-mentioned transfer position.

In the sixth guide portion 456 that slidably supports the primary transfer roller 45BK corresponding to black, the sixteenth support surface 425 and the twenty-fourth support surface 433 are located at the same position in the longitudinal direction and at the same height position. The seventeenth support surface 426 and the twenty-fifth support surface 434 are located at the same position in the longitudinal direction and at the same height position. Therefore, in accordance with the movements of the rail members 401, 402, the slider 406 provided at the primary transfer roller 45BK is allowed to take: a state of being supported by the sixteenth support surface 425 and the twenty-fourth support surface 433; and a state of being supported by the seventeenth support surface 426 and the twenty-fifth support surface 434.

The sixteenth support surface 425 and the twenty-fourth support surface 433 are located at positions higher than the seventeenth support surface 426 and the twenty-fifth support surface 434. Therefore, the primary transfer roller 45BK is located at the higher position when the primary transfer roller 45BK is supported by the sixteenth support surface 425 and the twenty-fourth support surface 433 than when it is supported by the seventeenth support surface 426 and the twenty-fifth support surface 434.

When the primary transfer roller 45BK is supported by the sixteenth support surface 425 and the twenty-fourth support surface 433, the primary transfer roller 45BK is spaced apart from the intermediate transfer belt 71. This position is the above-mentioned separation position. When the primary transfer roller 45BK is supported by the seventeenth support surface 426 and the twenty-fifth support surface 434, the primary transfer roller 45BK is in contact with the intermediate transfer belt 71. This position is the above-mentioned transfer position.

The driving motor 403 moves the rail member 401 and the rail member 402 integrally in the left-right direction 802. For example, a stepping motor or a DC motor may be used as the driving motor 403.

In the image forming apparatus 10, the positions of the backup rollers 75, 76 and the positions of the respective primary transfer rollers 45 have previously been determined for each of different situations, i.e., when no image is formed, when a monochrome image is formed, and when a color image is formed. The positions of the backup rollers 75, 76 are the above-mentioned contact position and non-contact position, and the positions of the respective primary transfer rollers 45 are the above-mentioned transfer position and separation position.

The positions and the lengths of the respective support surfaces 407 to 410, 413 to 417, and 419 to 434 in the rail members 401, 402 and the amounts of movements of the rail members 401, 402 have been determined so that the backup rollers 75, 76 and the respective primary transfer rollers 45 are located at the determined positions.

Figure 4A:
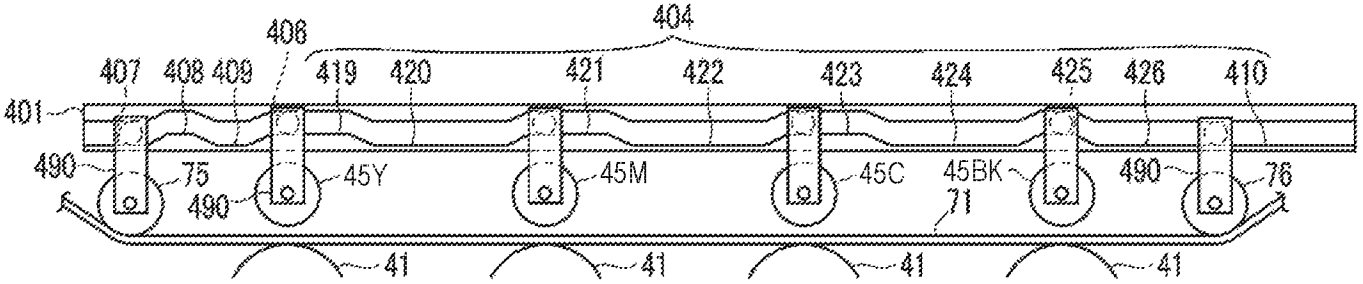
FIG. 4A, FIG. 4B, and FIG. 4C are explanation diagrams for the positions of transfer rollers and backup rollers in accordance with an amount of movement of the rail members.

When no image is formed, the rail members 401, 402 are located at a position where the backup roller 75 is supported by the first support surface 407 and the fifth support surface 413 and the backup roller 76 is supported by the fourth support surface 410 and the eighth support surface 416 (refer to FIG. 4A). At this time, the backup rollers 75, 76 are located at the contact position.

The primary transfer roller 45Y corresponding to yellow is supported by the tenth support surface 419 and the eighteenth support surface 427. The primary transfer roller 45M corresponding to magenta is supported by the twelfth support surface 421 and the twentieth support surface 429. The primary transfer roller 45C corresponding to cyan is supported by the fourteenth support surface 423 and the twenty-second support surface 431. The primary transfer roller 45BK corresponding to black is supported by the sixteenth support surface 425 and the twenty-fourth support surface 433. Thus, each primary transfer roller 45Y, 45M, 45C, and 45BK is located at the separation position.

When the primary transfer roller 45 located at the transfer position, the primary transfer roller 45 is in contact with the intermediate transfer belt 71 as described above, and the intermediate transfer belt 71 is held between the primary transfer roller 45 and the photosensitive drum 41. In this case, the transfer belt unit 74 or the photosensitive drum 41 cannot be removed from the housing 100.

In the present embodiment, since the primary transfer roller 45 is located at the separation position when no image is formed, the transfer belt unit 74 or the photosensitive drum 41 can be removed from the housing 100 when no image is formed.

Figure 4B:
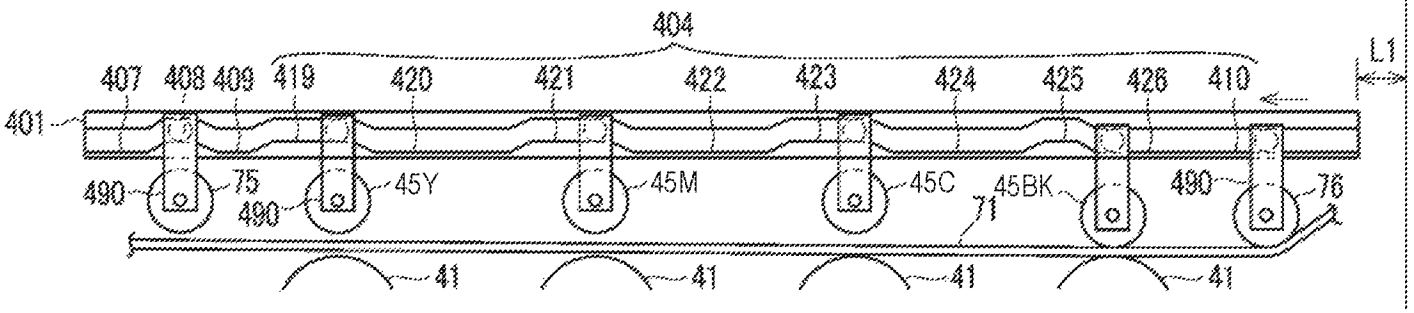

When a monochrome image is formed, the rail members 401, 402 are located at a position spaced apart by a distance L1 from the position where they are located when no image is formed. This position of the rail members 401, 402 is referred to as a first rail position. In the state where the rail members 401, 402 are located at the first rail position, the backup roller 75 is supported by the second support surface 408 and the sixth support surface 414. In addition, the backup roller 76 is supported by the fourth support surface 410 and the ninth support surface 417 (refer to FIG. 4B). At this time, the backup roller 75 is located at the non-contact position, and the backup roller 76 is located at the contact position. Since the backup roller 76 is located at the contact position, it is avoided that an excessive force from the intermediate transfer belt 71 is applied to the primary transfer roller 45BK corresponding to black disposed in the vicinity of the driving roller 72.

The primary transfer rollers 45Y, 45M, and 45C corresponding to yellow, magenta, and cyan are supported by the same support surfaces as those when no image is formed. On the other hand, the primary transfer roller 45BK corresponding to black is supported by the seventeenth support surface 426 and the twenty-fifth support surface 434. Thereby, the primary transfer rollers 45Y, 45M, and 45C corresponding to yellow, magenta, and cyan are located at the separation position while the primary transfer roller 45BK corresponding to black is located at the transfer position.

Figure 4C:
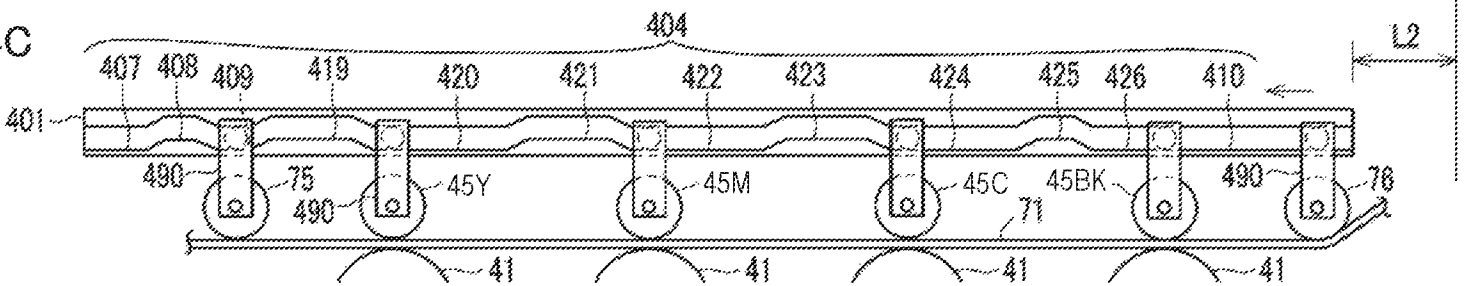

When a color image is formed, the rail members 401, 402 are located at a position spaced apart by a distance L2 from the position where they are located when no image is formed. Hereinafter, this position is referred to as a second rail position. In the state where the rail members 401, 402 are located at the second rail position, the backup roller 75 is supported by the third support surface 409 and the seventh support surface 415. In addition, the backup roller 76 is supported by the fourth support surface 410 and the ninth support surface 417 (refer to FIG. 4C). Thereby, the backup rollers 75, 76 are located at the contact position. Since the backup rollers 75, 76 are located at the contact position, it is avoided that an excessive force from the intermediate transfer belt 71 is applied to the primary transfer rollers 45Y and 45BK corresponding to yellow and black disposed in the vicinity of the driving roller 72 and the follower roller 73, respectively.

Further, the primary transfer roller 45Y corresponding to yellow is supported by the eleventh support surface 420 and the nineteenth support surface 428. The primary transfer roller 45M corresponding to magenta is supported by the thirteenth support surface 422 and the twenty-first support surface 430. The primary transfer roller 45C corresponding to cyan is supported by the fifteenth support surface 424 and the twenty-third support surface 432. The primary transfer roller 45BK corresponding to black is supported by the same support surfaces as those when a monochrome image is formed. Thus, each primary transfer roller 45Y, 45M, 45C, and 45BK is located at the transfer position.

As described above, the first to fourth support surfaces 407 to 410 and the fifth to ninth support surfaces 413 to 417 cause the backup rollers 75, 76 to move between the contact position and the non-contact position in the up-down direction 801. In addition, the tenth to twenty-fifth support surfaces 419 to 434 cause the primary transfer rollers 45 to move between the separation position and the transfer position in the up-down direction 801.

In the image forming apparatus 10, the position of the rail members 401, 402 when no image is formed is set as a home position of the rail members 401, 402. When the image forming apparatus 10 executes an image formation job, the rail members 401, 402 are moved by the driving motor 403 from the home position to the first rail position or the second rail position, depending on whether the image formation job is a monochrome image formation job or a color image formation job.

The image forming apparatus 10 includes a position detecting portion which detects that the rail member 401 is located at the home position, and a movement amount detecting portion which detects the amount of movement of the rail member 401 from the home position, although these portions are not shown in the drawings. As the position detecting portion, for example, an optical sensor including a light-emitting portion composed of a light emitting diode and a light-receiving portion composed of a phototransistor may be adopted. As the movement amount detecting portion, a rotary encoder or the like may be adopted.

By the way, the height position of the first support surface 407 formed in the rail member 401 is set to be lower than that of the fifth support surface 413 formed in the rail member 402. Therefore, when the end portions of the backup roller 75 are supported by the first support surface 407 and the fifth support surface 413, the end portion supported by the rail member 401 is lower than the end portion supported by the rail member 402, whereby the backup roller 75 is tilted.

On the other hand, the second support surface 408 and the sixth support surface 414 are located at the same height position, and the third support surface 409 and the seventh support surface 415 are located at the same height position. That is, when the end portions of the backup roller 75 are supported by the first support surface 407 and a support surface other than the fifth support surface 413, the backup roller 75 is in a horizontal orientation.

Therefore, the orientation of the backup roller 75 is changed between the tilting orientation and the horizontal orientation when the state of the backup roller 75 is shifted between the state of being supported by the first support surface 407 and the fifth support surface 413 and the state of being supported by the second support surface 408 and the sixth support surface 414.

In addition, the height position of the fourth support surface 410 formed at the rail member 401 is set to be lower than that of the eighth support surface 416 formed at the rail member 402. Therefore, when the end portions of the backup roller 76 are supported by the fourth support surface 410 and the eighth support surface 416, the end portion supported by the rail member 401 is lower than the end portion supported by the rail member 402, whereby the backup roller 76 is tilted.

On the other hand, the fourth support surface 410 is located at the same height position as the ninth support surface 417. That is, when the end portions of the backup roller 76 is supported by the fourth support surface 410 and a support surface other than the eighth support surface 416, the backup roller 76 is in the horizontal orientation.

Therefore, the orientation of the backup roller 76 is changed between the tilting orientation and the horizontal orientation when the state of the backup roller 76 is shifted between the state of being supported by the fourth support surface 410 and the eighth support surface 416 and the state of being supported by the fourth support surface 410 and the ninth support surface 417.

Figure 6A:
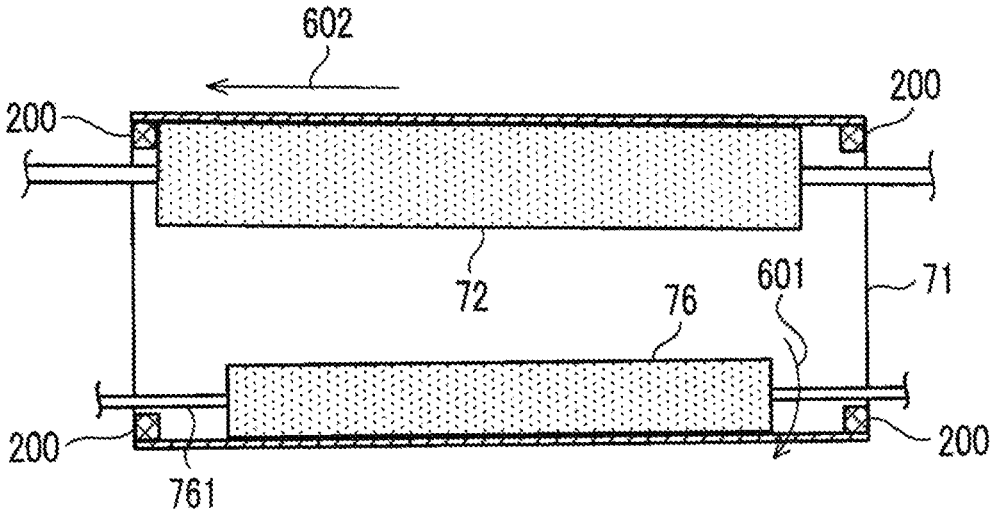
FIG. 6A and FIG. 6B are diagrams showing movement of an intermediate transfer belt in its width direction in accordance with change in the orientation of the backup roller.
Figure 6B:
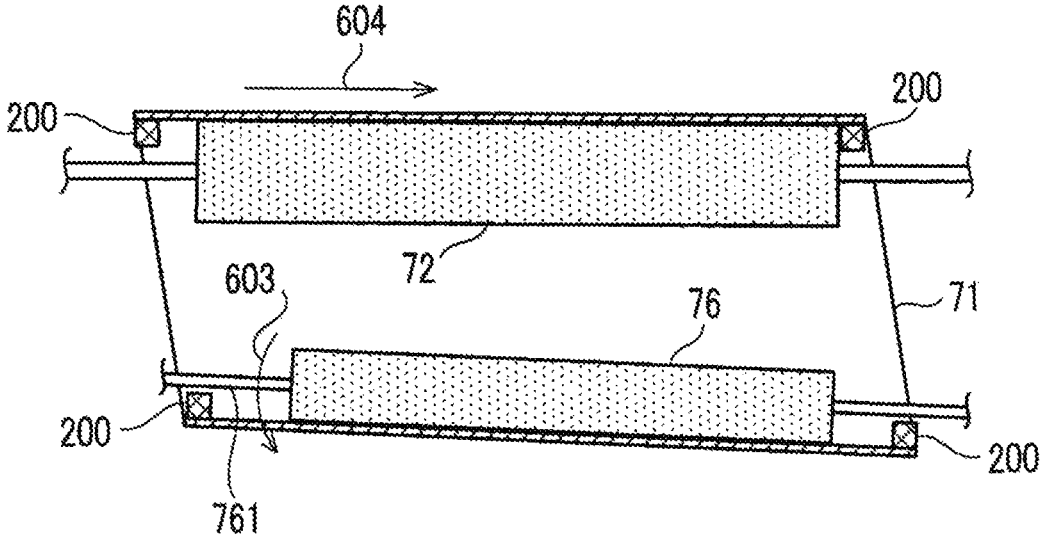

In the present embodiment, the driving roller 72 and the follower roller 73 are disposed so as to be tilted by a predetermined angle within a plane orthogonal to the left-right direction 802 (refer to FIG. 6A and FIG. 6B). Therefore, if the orientation of the backup rollers 75, 76 is different from the orientation of the driving roller 72 and the follower roller 73, a difference in tension occurs between one end of the intermediate transfer belt 71 in the width direction and the other end thereof in the width direction. As a result, the intermediate transfer belt 71 is displaced in a direction according to the difference in tension, which direction is either the axial direction of the driving roller 72 or the axial direction of the follower roller 73.

When an image forming process is performed, the backup rollers 75, 76 are in the horizontal orientation which is different from the orientation of the driving roller 72 and the follower roller 73. Thereby, when the image forming process is performed, the intermediate transfer belt 71 is located at a position close to the end portion in the direction where the above-mentioned tension is relatively small, which direction is either the axial direction of the driving roller 72 or the axial direction of the follower roller 73. The intermediate transfer belt 71 runs at that position when the image forming process is performed.

The intermediate transfer belt 71 includes restricting portions 200. The restricting portions 200 are ribs provided annually or circumferentially at regular intervals on an inner circumferential surface at the both ends of the intermediate transfer belt 71 in the width direction. When the intermediate transfer belt 71 is displaced in the width direction, the restricting portions 200 can come into contact with the end portions of the driving roller 72 and the end portions of the follower roller 73. The restricting portions 200 restrict the range of movement of the intermediate transfer belt 71 in the width direction, and prevent the intermediate transfer belt 71 from dropping from the driving roller 72 and the follower roller 73.

As described above, the driving mechanism 400 is able to cause each of the primary transfer rollers 45 to come into contact with or separate from the intermediate transfer belt 71. Further, the driving mechanism 400 is able to change the orientations of the backup rollers 75, 76. That is, the driving mechanism 400 is provided at the rail member 401, 402, supports one end or both ends of the backup roller 75, 76, and displaces the relative position of the both ends of the rail member 401, 402 in the up-down direction 801 so as to be the tilting orientation, in accordance with movement of the primary transfer roller 45 to the separation position. Further, the driving mechanism 400 displaces the relative position so as to be the tilting orientation, in accordance with movement of the primary transfer roller 45 to the transfer position. The tilting orientation is an example of a first orientation of the present disclosure. The horizontal orientation is an example of a second orientation of the present disclosure. The rail members 401, 402 support the rotation shafts 451 of the plurality of primary transfer rollers 45. Then, the rail members 401, 402, in accordance with movements thereof in the left-right direction 802, cause the plurality of primary transfer rollers 45 to move between the separation position where each of the primary transfer rollers 45 is spaced apart from the intermediate transfer belt 71 and the transfer position where each of the primary transfer rollers 45 is in contact with the intermediate transfer belt 71. The separation position is an example of a first position of the present disclosure, and the transfer position is an example of a second position of the present disclosure. The left-right direction 802 is an example of a predetermined movement direction. The driving mechanism 400 is an example of a first driving portion and a second driving portion of the present disclosure. The backup roller 75, 76 is an example of a movable roller of the present disclosure.

As shown in FIG. 2, the image forming apparatus 10 includes a control portion 700. The control portion 700 includes a CPU (Central Processing Unit), a ROM (Read Only Memory), and a RAM (Random Access Memory).

The CPU is a processor that executes various calculation processes. The ROM is a non-volatile storage portion in which information such as control programs for causing the CPU to execute various processes is previously stored. The RAM is a volatile storage portion which is used as a temporary storage memory (workspace) for the various processes executed by the CPU. The CPU executes the program stored in the ROM, whereby the control portion 700 controls the operation of the image forming apparatus 10.

In the ROM of the control portion 700, a processing program for causing the CPU of the control portion 700 to execute processing (refer to a flowchart in FIG. 7) described later is previously stored. The processing program may be stored in the ROM at the stage of shipment of the image forming apparatus 10. Alternatively, the processing program may be stored in a non-transitory computer-readable information storage medium such as a CD (Compact Disc), a DVD (Digital Versatile Disc), or a flash memory, and may be installed from the information storage medium in the ROM of the control portion 700. It is also conceivable as another embodiment that part or a plurality of the functions of the control portion 700 are implemented as electronic circuits.

The CPU executes the processing program stored in the ROM, whereby the control portion 700 functions as a running control portion 701. A configuration can also be used in which part or a plurality of the functions of the control portion 700 are implemented as electronic circuits.

The running control portion 701, by using the driving mechanism 400, executes a foreign matter removing process for removing foreign matters that enter the gap between the tip of the cleaning blade 491 and the surface of the intermediate transfer belt 71. The foreign matter removing process is realized by a running process including: causing the driving mechanism 400 to separate each primary transfer roller 45 from the intermediate transfer belt 71; causing the driving mechanism 400 to change the orientations of the backup rollers 75, 76 to orientations different from those in execution of the image forming process; and causing the intermediate transfer belt 71 to run.

When the orientations of the backup rollers 75, 76 are changed, a difference in tension occurs between the both ends of the intermediate transfer belt 71 in the width direction. If such a difference in tension between the both ends of the intermediate transfer belt 71 in the width direction occurs when the intermediate transfer belt 71 is running, the intermediate transfer belt 71 moves in a direction from the end portion where the tension is relatively large toward the end portion where the tension is relatively small, which direction is either the axial direction of the driving roller 72 or the axial direction of the follower roller 73.

For example, when the backup roller 75, 76 in the horizontal orientation as shown in FIG. 6A is tilted in the direction of an arrow 601 to be in the tilting orientation as shown in FIG. 6B, the intermediate transfer belt 71 moves to the position shown in FIG. 6B in the direction of an arrow 602 shown in FIG. 6A.

Further, when an end of the backup roller 75, 76 in the tilting orientation as shown in FIG. 6B is displaced in the direction of an arrow 603 and thereby the backup roller 75, 76 is in the horizontal orientation shown in FIG. 6A, the intermediate transfer belt 71 moves to the position shown in FIG. 6A in the direction of an arrow 604 shown in FIG. 6B.

In the present embodiment, by causing the intermediate transfer belt 71 to move in the width direction as described above while running, the intermediate transfer belt 71 and the cleaning blade 491 are caused to rub each other in the width direction of the intermediate transfer belt 71. Thereby, a force in the width direction is applied to the foreign matters that enter the gap between the tip of the cleaning blade 491 and the surface of the intermediate transfer belt 71, and the foreign matters are removed from the gap.

Figure 7:
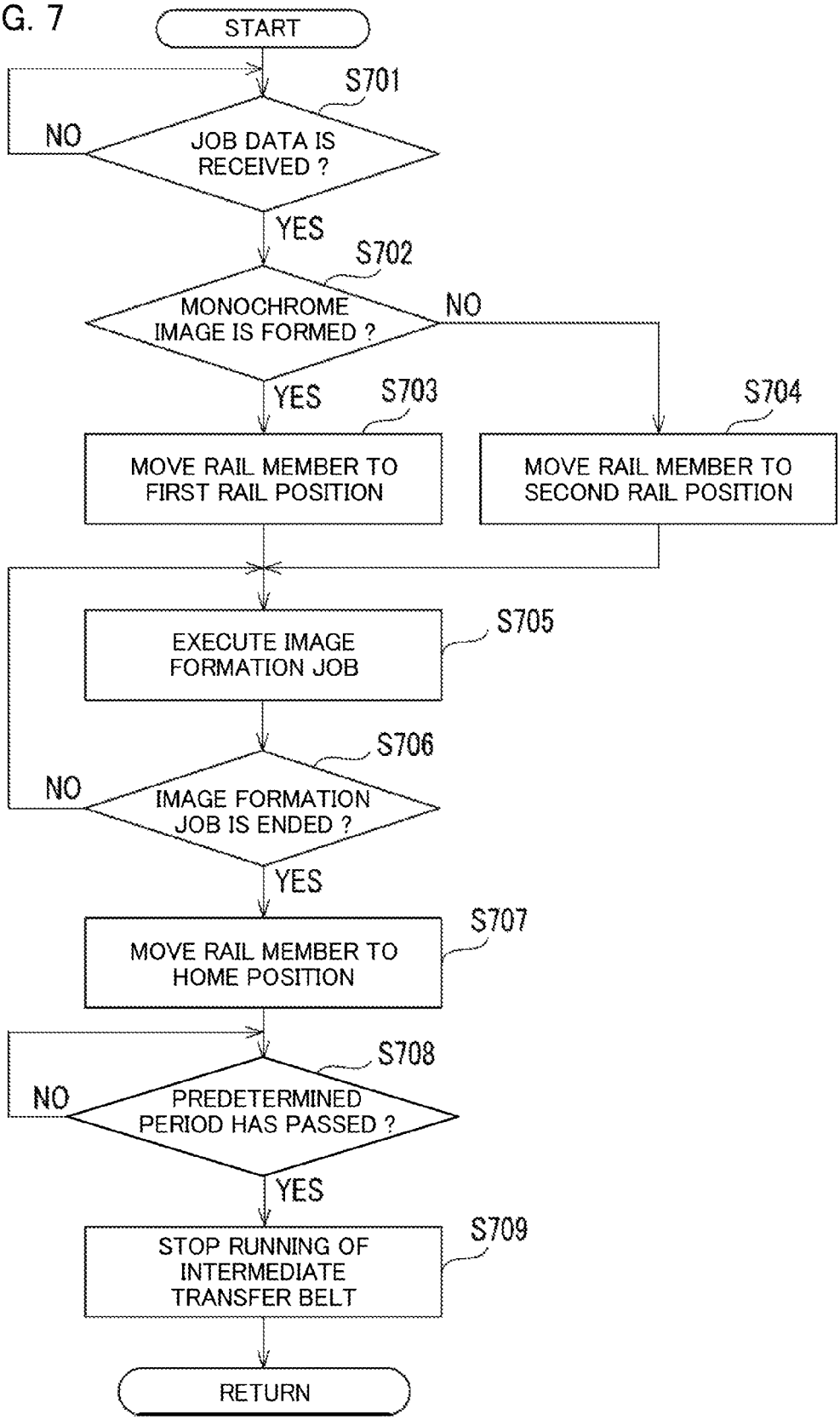
FIG. 7 is a flowchart showing a running process performed by a control portion of the image forming apparatus according to the first embodiment of the present disclosure.

Next, the processing performed by the control portion 700 will be described with reference to FIG. 7. In the flowchart in FIG. 7, steps S701, S702, indicate process procedure (step) numbers. It is assumed that the image forming apparatus 10 is in the mode where no image is formed. The backup roller 75 is in the state of being supported by the first support surface 407 and the fifth support surface 413. The backup roller 76 is in the state of being supported by the fourth support surface 410 and the tenth support surface 419. That is, the intermediate transfer belt 71 is in the above-mentioned tilting orientation.

<Step S701>

In step S701, the control portion 700 determines whether or not job data indicating the image formation job has been received from another communication apparatus. Upon determining that the job data has not been received from another communication apparatus (NO in step S701), the control portion 700 again executes the process of step S701. On the other hand, upon determining that the job data has been received from another communication apparatus (YES in step S701), the control portion 700 executes the process of step S702.

<Step S702>

In step S702, the control portion 700 determines, based on the job data, whether or not an image is to be formed in monochrome. Upon determining, based on the job data, that an image is to be formed in monochrome (YES in step S702), the control portion 700 executes the process of step S703. On the other hand, upon determining that an image is to be formed in color (NO in step S702), the control portion 700 executes the process of step S704.

<Step S703>

In step S703, the running control portion 701 moves the rail members 401, 402 to the first rail position displaced by the distance L1 from the home position. Thereby, the primary transfer roller 45BK corresponding to black is supported by the seventeenth support surface 426 and the twenty-fifth support surface 434. Therefore, the primary transfer roller 45BK is located at the transfer position. Further, the primary transfer roller 45Y corresponding to yellow is supported by the tenth support surface 419 and the eighteenth support surface 427. The primary transfer roller 45M corresponding to magenta is supported by the twelfth support surface 421 and the twentieth support surface 429. The primary transfer roller 45C corresponding to cyan is supported by the fourteenth support surface 423 and the twenty-second support surface 431. Therefore, the primary transfer rollers 45Y, 45M, and 45C are located at the separation position.

The backup roller 75 is supported by the second support surface 408 and the sixth support surface 414, and therefore, is located at the non-contact position. The backup roller 76 is supported by the fourth support surface 410 and the ninth support surface 417, and therefore, is located at the contact position.

At this time, the state of the backup roller 75 changes from the state of being supported by the first support surface 407 and the fifth support surface 413 to the state of being supported by the second support surface 408 and the sixth support surface 414. Thereby, the orientation of the backup roller 75 changes from the tilting orientation to the horizontal orientation. Further, the state of the backup roller 76 changes from the state of being supported by the fourth support surface 410 and the eighth support surface 416 to the state of being supported by the fourth support surface 410 and the ninth support surface 417. Thus, the orientation of the backup roller 76 changes from the tilting orientation to the horizontal orientation.

As described above, the driving mechanism 400 changes the orientations of the backup rollers 75, 76 to the orientations different from those when no image is formed, in accordance with the operation of causing each of the primary transfer rollers 45 to be in contact with the intermediate transfer belt 71.

After the process of step S703, the control portion 700 performs the process of step S705.

<Step S704>

In step S704, the running control portion 701 moves the rail members 401, 402 to the second rail position displaced by the distance L2 from the home position. Thereby, the primary transfer roller 45Y corresponding to yellow is supported by the eleventh support surface 420 and the nineteenth support surface 428. The slider 406 provided at the primary transfer roller 45M corresponding to magenta is supported by the thirteenth support surface 422 and the twenty-first support surface 430. The slider 406 provided at the primary transfer roller 45C corresponding to cyan is supported by the fifteenth support surface 424 and the twenty-third support surface 432. The primary transfer roller 45BK corresponding to black is supported by the seventeenth support surface 426 and the twenty-fifth support surface 434. Thus, each primary transfer roller 45Y, 45M, 45C, and 45BK is located at the transfer position.

Further, the backup roller 75 is in the state of being supported by the third support surface 409 and the seventh support surface 415, and therefore, is located at the contact position. The backup roller 76 is in the state of being supported by the fourth support surface 410 and the ninth support surface 417, and therefore, is located at the contact position.

After the process of step S704, the control portion 700 performs the process of step S705.

<Step S705>

In step S705, the control portion 700 executes the image formation job on the basis of image data contained in the job data. At this time, running of the intermediate transfer belt 71 is started. Then, the control portion 700 performs the process of step S706.

<Step S706>

In step S706, the control portion 700 determines whether or not the image formation job is completed, on the basis of whether or not image data to be subjected to the image forming process remains. Upon determining that the image formation job is not completed (NO in step S706), the control portion 700 performs the process of step S705. On the other hand, upon determining that the image formation job is completed (YES in step S706), the control portion 700 performs the process of step S707.

<Step S707>

In step S707, the running control portion 701 moves the rail members 401, 402 to the home position. Thereby, the primary transfer roller 45Y corresponding to yellow is supported by the tenth support surface 419 and the eighteenth support surface 427. The primary transfer roller 45M corresponding to magenta is supported by the twelfth support surface 421 and the twentieth support surface 429. The primary transfer roller 45C corresponding to cyan is supported by the fourteenth support surface 423 and the twenty-second support surface 431. The primary transfer roller 45BK corresponding to black is supported by the sixteenth support surface 425 and the twenty-fourth support surface 433. Thus, each primary transfer roller 45Y, 45M, 45C, and 45BK is located at the separation position.

Further, the backup roller 75 is in the state of being supported by the first support surface 407 and the fifth support surface 413, and therefore, is located at the contact position. The backup roller 76 is in the state of being supported by the fourth support surface 410 and the eighth support surface 416, and therefore, is located at the contact position.

At this time, the state of the backup roller 75 changes from the state of being supported by the second support surface 408 and the sixth support surface 414 to the state of being supported by the first support surface 407 and the fifth support surface 413. Thereby, the orientation of the backup roller 75 changes from the horizontal orientation to the tilting orientation. In addition, the state of the backup roller 76 changes from the state of being supported by the fourth support surface 410 and the ninth support surface 417 to the state of being supported by the fourth support surface 410 and the eighth support surface 416. Thus, the orientation of the backup roller 76 changes from the horizontal orientation to the tilting orientation.

As described above, the driving mechanism 400 changes the orientations of the backup rollers 75, 76 to the orientation different from those when the monochrome or color image forming process is executed, in accordance with the operation of causing each of the primary transfer rollers 45 to separate from the intermediate transfer belt 71.

At this time, the intermediate transfer belt 71 is running. Since the intermediate transfer belt 71 moves in the width direction as described above while running, the intermediate transfer belt 71 and the cleaning blade 491 rub each other in the width direction of the intermediate transfer belt 71. Thereby, a force in the width direction is applied to the foreign matters that enter the gap between the tip of the cleaning blade 491 and the surface of the intermediate transfer belt 71, and the foreign matters are removed from the gap. This foreign matter removing process is performed after the image forming process has been executed, by the time the next image forming process is started.

The primary transfer rollers 45 corresponding to the respective colors are located at the separation position. If the intermediate transfer belt 71 is moved in the width direction while the respective primary transfer rollers 45 and the corresponding photosensitive drums 41 are in contact with the intermediate transfer belt 71, the primary transfer rollers 45 and the photosensitive drums 41 rub the intermediate transfer belt 71, and these members might be damaged. In the present embodiment, however, since the primary transfer rollers 45 are located at the separation position, such damages are not likely to occur.

<Step S708>

In step S708, the control portion 700 determines whether or not a predetermined period has passed from when the rail member 401 is moved to the home position. Upon determining that the predetermined period has not passed (NO in step S708), the control portion 700 again performs the process of step S708. On the other hand, when the control portion 700 has determined that the predetermined period has passed (YES in step S708), the running control portion 701 stops running of the intermediate transfer belt 71 to end the running process of step S709.

As described above, in the present embodiment, when the image forming process has ended, the rail members 401, 402 are moved to move the intermediate transfer belt 71 in the width direction. Thereby, the intermediate transfer belt 71 and the cleaning blade 491 rub each other in the width direction of the intermediate transfer belt 71, whereby the foreign matters can be removed from the gap.

When the intermediate transfer belt 71 is moved in the width direction, the primary transfer rollers 45 corresponding to the respective colors are located at the separation position. Therefore, the respective primary transfer rollers 45, the photosensitive drums 41 and the intermediate transfer belt 71 are prevented from rubbing each other and being damaged. Thus, it is possible to remove the foreign matters that enter the gap between the tip of the cleaning blade 491 and the surface of the intermediate transfer belt 71 while preventing the primary transfer rollers 45, the photosensitive drums 41, the intermediate transfer belt 71, and the like from being damaged.

The preferred embodiments of the present disclosure have been described above. However, the present disclosure is not limited to the contents described above. Various modifications can be made.

In the first embodiment, the intermediate transfer belt 71 is moved in the width direction by changing the orientations of the backup rollers 75, 76. However, the rollers the orientations of which are changed to move the intermediate transfer belt 71 in the width direction are not limited to the backup rollers 75, 76. The rollers the orientations of which are changed may be the driving roller 72, the follower roller 73, or other extending rollers (if provided).

The image forming apparatus 10 includes the two backup rollers 75, 76, and changes the orientations of the backup rollers 75, 76. However, the number of the backup rollers is not limited to two. One or three or more backup rollers may be provided.

In the first embodiment, displacement of the intermediate transfer belt 71 and displacement of each primary transfer roller 45 are performed by using the common driving mechanism 400. However, an embodiment in which displacement of the intermediate transfer belt 71 and displacement of the primary transfer roller 45 are performed by using different driving mechanisms can also be adopted. In this case, the driving mechanism used for displacement of the primary transfer roller 45 is an example of a first driving portion of the present disclosure, and the driving mechanism used for displacement of the intermediate transfer belt 71 is an example of a second driving portion of the present disclosure.

In the case where displacement of the intermediate transfer belt 71 and displacement of the primary transfer roller 45 are performed by using different driving mechanisms, each of the driving mechanisms can be composed of a rail member and a driving motor for driving the rail member, like in the first embodiment. However, for example, the driving mechanism used for displacement of the intermediate transfer belt 71 may be configured as follows. In the following description, a roller the orientation of which is to be changed is the follower roller 73. However, as described above, the roller the orientation of which is to be changed is not limited to the follower roller 73.

Figure 8:
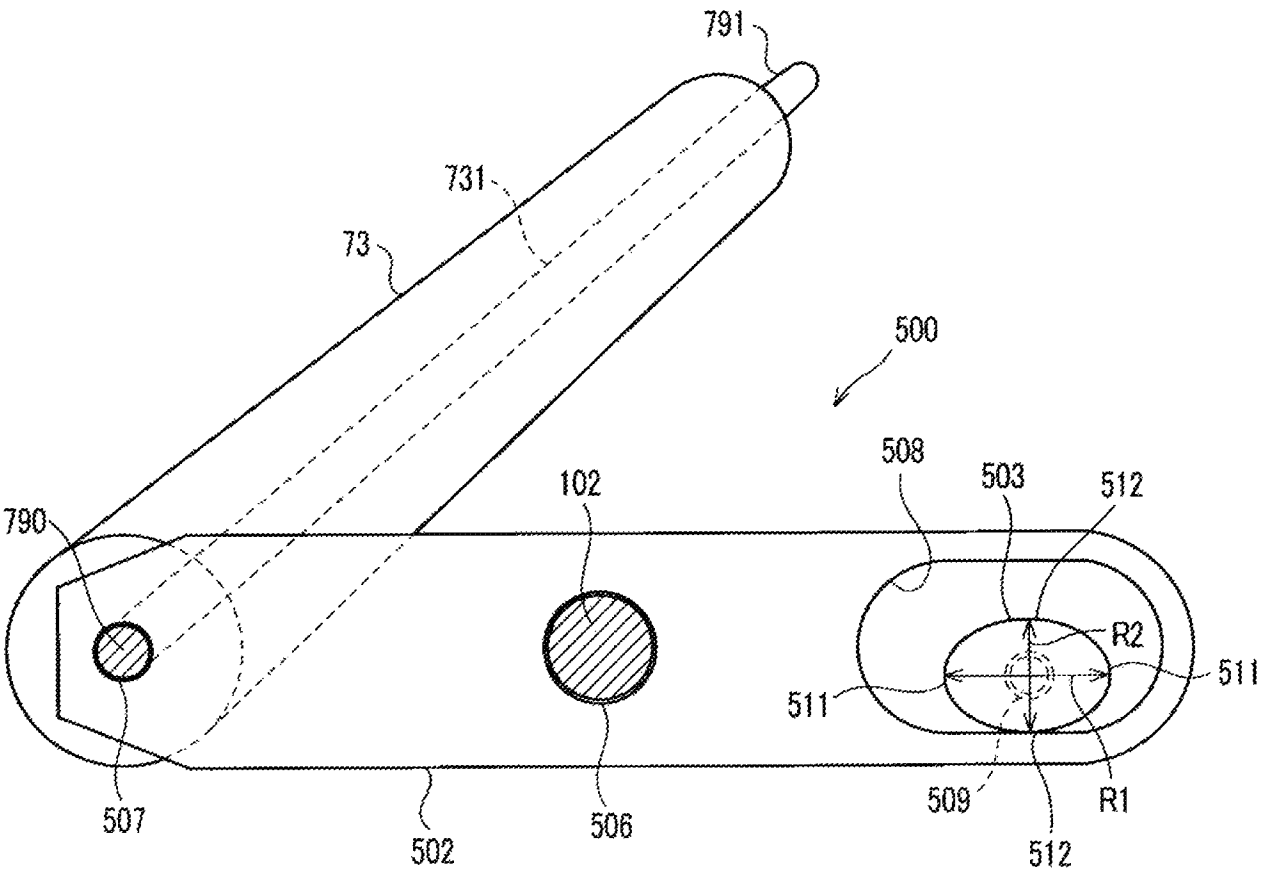
FIG. 8 is a diagram showing another configuration to move the intermediate transfer belt in the width direction.
Figure 9:
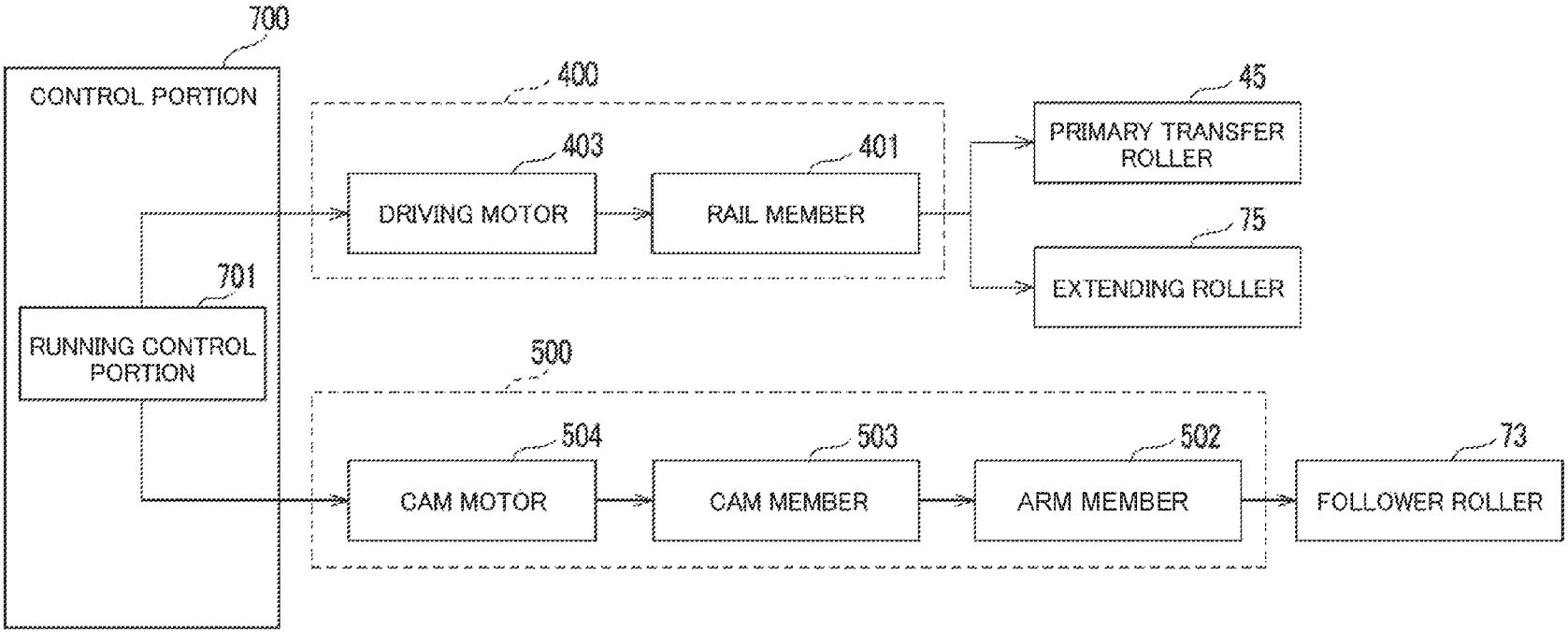
FIG. 9 is a block diagram of an image forming apparatus in which the configuration of FIG. 8 is adopted.

As shown in FIG. 8 and FIG. 9, the image forming apparatus 10 includes a tilt mechanism 500. The tilt mechanism 500 includes an arm member 502, a cam member 503, and a cam motor 504.

The arm member 502 is an elongated plate-shaped member. The arm member 502 has a first through-hole 506, a second through-hole 507, and a third through-hole 508. In the first through-hole 506, a support shaft 102 projected from the housing 100 is fitted. The arm member 502 is rotatably supported by the support shaft 102 projected from the housing 100. In the second through-hole 507, an end of a rotation shaft 731 of the follower roller 73 is inserted. The third through-hole 508 has a substantially elliptical shape.

The cam member 503 is a substantially elliptical plate-like member which is connected to a motor axis 509 of the cam motor 504, and rotates about the connection portion. The cam member 503 includes, roughly, a major diameter portion 511 having a distance (radius) R1 from the rotation center, and a minor axis portion 512 having a distance R2 from the rotation center. The distance R1 is longer than the distance R2. The cam member 503 is smaller than the third through-hole 508 and is fitted in the third through-hole 508.

The cam motor 504 generates a driving force for rotating the cam member 503. For example, a stepping motor or a DC motor may be used as the cam motor 504.

The arm member 502 is urged by an urging member (not shown) such as a spring in a counterclockwise direction, in other words, in a direction in which the third through-hole 508 is displaced upward. Therefore, the cam member 503 and a lower edge portion of the third through-hole 508 are always in contact with each other.

When an image is formed, an edge portion of the minor axis portion 512, at the lower side of the cam member 503, is in contact with the lower edge portion of the third through-hole 508. At this time, one end portion (in FIG. 8, a near-side end portion) 790 of the rotation shaft 731 in the follower roller 73 is located at a height position lower than the other end portion 791 thereof. The follower roller 73 is oriented such that the end portion (in FIG. 8, the near-side end portion) 790 on the second through-hole 507 side is tilted downward.

Figure 10:
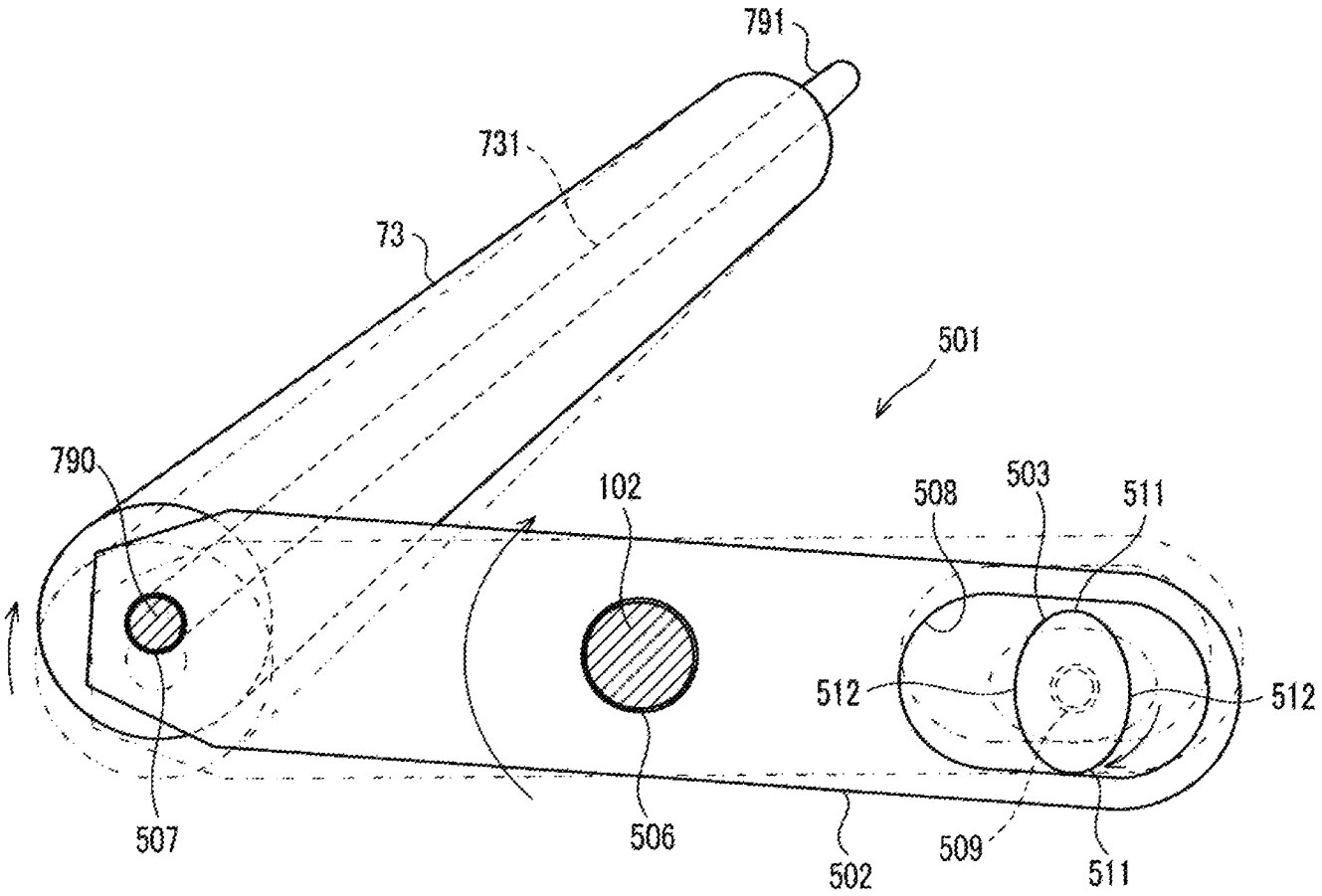
FIG. 10 is an explanation diagram for the function of a tilt mechanism.

As shown in FIG. 10, when the cam member 503 is rotated from the state shown in FIG. 8 and an edge portion of the major diameter portion 511 comes in contact with the lower edge portion of the third through-hole 508, a portion of the arm member 502 on the third through-hole 508 side is pushed down by the cam member 503. Thereby, the arm member 502 rotates in a clockwise direction, in other words, in a direction in which the second through-hole 507 is displaced upward. Accordingly, the one end portion (in FIG. 10, the near-side end portion) 790 of the rotation shaft 731 of the follower roller 73 is displaced upward and is located at a height position higher than the other end portion 791. Since the other end portion 791 of the rotation shaft 731 of the follower roller 73 is supported by the housing 100, the follower roller 73 is oriented such that the end portion (in FIG. 10, the near-side end portion) 790 on the second through-hole 507 side is tilted upward.

Thus, the above-mentioned embodiment in which the intermediate transfer belt 71 is moved in the width direction by rotating the cam member 503 to change the orientation of the follower roller 73, can also be adopted as another embodiment.

In the first embodiment, the above-mentioned foreign matter removing process of removing the foreign matters that enter the gap between the tip of the cleaning blade 491 and the surface of the intermediate transfer belt 71 is executed after the image forming process has been executed, by the time the next image forming process is started. However, the timing to execute the foreign matter removing process is not limited to the above timing.

For example, when a main power supply (not shown) of the image forming apparatus 10 is turned on, various preparation processes are performed in the image forming apparatus 10. One of the preparation processes is warming-up of the fixing portion 6. The warming-up is a process of heating the fixing roller 61 to a predetermined fixing temperature by applying current to the heater 63. An embodiment in which the foreign matter removing process is performed while such warming-up is executed, can also be adopted as a modification of the present disclosure.

An embodiment in which the foreign matter removing process is performed while cleaning of the emission windows 99 is executed by the exposure cleaning portion 900, can also be adopted as a modification of the present disclosure.

An embodiment in which the foreign matter removing process is executed while various maintenance processes, other than the warming-up and the cleaning of the emission windows 99, are executed in the image forming apparatus 10, can also be adopted as another embodiment. The various maintenance processes may include, for example, calibration of toner density, refresh of the photosensitive drums 41, refresh of the developing devices 43, and cleaning of the charging device 42.

In the first embodiment, the orientations of the backup rollers 75, 76 are changed between the horizontal orientation and the tilting orientation. However, the mode of changing the orientations of the backup rollers 75, 76 is not limited to this mode. For example, the backup roller 75, 76 may be tilted so that one end thereof is lower than the other end thereof while the image forming process is executed, and the backup roller 75, 76 may be tilted so that one end thereof is higher than the other end while the foreign matter removing process is executed. That is, the high-low relationship between the one end and the other end of the backup roller 75, 76 may be inverted between when the image forming process is executed and when the foreign matter removing process is executed.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an intermediate transfer belt onto which toner images formed on a plurality of image carriers are transferred;

a plurality of belt rollers including a driving roller that causes the intermediate transfer belt to run, and extending rollers on and between which the intermediate transfer belt is extended;

a plurality of transfer rollers holding the intermediate transfer belt between the transfer rollers and the respective image carriers;

a cleaning member disposed in contact with a surface of the intermediate transfer belt;

a first driving portion capable of causing the respective transfer rollers to come into contact with or separate from the intermediate transfer belt;

a second driving portion capable of changing orientation of predetermined one or a plurality of movable rollers among the plurality of belt rollers; and a running control portion configured to execute a running process including: causing the first driving portion to separate the respective transfer rollers from the intermediate transfer belt; causing the second driving portion to change the orientation of the movable roller to orientation different from that during execution of an image forming process; and causing the intermediate transfer belt to run.

2. The image forming apparatus according to claim 1, wherein the second driving portion changes the orientation of the movable roller to a first orientation different from that during execution of the image forming process, in accordance with the operation of causing the transfer rollers to separate from the intermediate transfer belt by the first driving portion, and changes the orientation of the movable roller to a second orientation corresponding to execution of the image forming process, in accordance with the operation of causing the transfer rollers to come into contact with the intermediate transfer belt by the first driving portion.

3. The image forming apparatus according to claim 2, wherein the first driving portion includes:

a rail member configured to support rotation shafts of the plurality of transfer rollers, and cause the plurality of transfer rollers to move between a first position in which the respective transfer rollers are spaced apart from the intermediate transfer belt and a second position in which the respective transfer rollers are in contact with the intermediate transfer belt, in accordance with movement of the rail member in a predetermined movement direction; and a rail driving portion configured to move the rail member in the movement direction, wherein the second driving portion is provided at the rail member, supports one or both ends of the movable roller, displaces a relative position of the both ends of the movable roller in an up-down direction so as to correspond to the first orientation in accordance with movement of the transfer rollers to the first position, and displaces the relative position so as to correspond to the second orientation in accordance with movement of the transfer rollers to the second position.

4. The image forming apparatus according to claim 1, wherein the running control portion executes the running process after the image forming process has been executed, by the time the next image forming process is started.

5. The image forming apparatus according to claim 1, further comprising:

a fixing roller configured to fix a toner image transferred from the intermediate transfer belt onto a sheet member; and a heating portion configured to heat the fixing roller, wherein the running control portion executes the running process by the time the fixing roller is heated by the heating portion to a predetermined fixing temperature.

6. The image forming apparatus according to claim 1, further comprising:

an exposure portion configured to irradiate surfaces of the image carriers with light to form electrostatic latent images on the surfaces of the image carriers; and an exposure cleaning portion configured to clean emission windows for the light in the exposure portion, wherein the running control portion executes the running process while cleaning of the exposure portion is executed by the exposure cleaning portion.

7. The image forming apparatus according to claim 1, wherein the second driving portion is able to invert a high-low relationship between one end and the other end of the movable roller, between execution of the image forming process and execution of the running process.

8. The image forming apparatus according to claim 1, wherein the movable roller is, among the plurality of belt rollers, a belt roller disposed near an upstream side of the transfer roller disposed on a most upstream side in a running direction of the intermediate transfer belt, or a belt roller disposed near a downstream side of the transfer roller disposed on a most downstream side in the running direction.

* * * * *